United States Patent [19]

Marks

[11] 4,392,350

[45] Jul. 12, 1983

[54] STIRLING ENGINE POWER CONTROL AND MOTION CONVERSION MECHANISM

[75] Inventor: David T. Marks, Birmingham, Mich.

[73] Assignee: Mechanical Technology Incorporation, Latham, N.Y.

[21] Appl. No.: 246,665

[22] Filed: Mar. 23, 1981

[51] Int. Cl.[3] ..... F02G 1/06

[52] U.S. Cl. ..... 60/518; 60/525; 74/53; 92/13.7

[58] Field of Search ..... 60/518, 525; 91/277; 92/13, 13.7; 74/53, 833

[56] References Cited

U.S. PATENT DOCUMENTS 2,099,206 11/1937 Hedblom ..... 92/13.7 X 2,147,989 2/1939 Puurmann ..... 92/13.7 X

FOREIGN PATENT DOCUMENTS 909843 5/1946 France ..... 92/13.7

*Primary Examiner*—Allen M. Ostrager

*Assistant Examiner*—Stephen F. Husar

*Attorney, Agent, or Firm*—Joseph V. Claeys; Arthur N. Trausch, III

[57] ABSTRACT

A motion conversion device for converting between the reciprocating motion of the pistons in a Stirling engine and the rotating motion of its output shaft, and for changing the stroke and phase of the pistons, includes a lever pivoted at one end and having a cam follower at the other end. The piston rod engages the lever intermediate its ends and the cam follower engages a cam keyed to the output shaft. The lever pivot can be moved to change the length of the moment arm defined between the cam follower and the piston rod the change the piston stroke and force exerted on the cam, and the levers can be moved in opposite directions to change the phase between pistons.

9 Claims, 3 Drawing Figures

STIRLING ENGINE POWER CONTROL AND MOTION CONVERSION MECHANISM

The Government of the United States of America has rights in this invention pursuant to Contract No. DEN3-32 awarded by the United States Department of Energy.

BACKGROUND OF THE INVENTION

This invention relates to a power control and motion conversion device for a reciprocating heat engine, and more particularly to a Stirling engine power control and motion conversion device for power modulation and conversion of the reciprocating motion of the pistons to rotating motion of an output shaft. This invention is related to the inventions disclosed in Application Ser. No. 242,453 for a "Phase Control for Double-Acting Stirling Machine" and Application Ser. No. 242,452 for "Independently Variable Phase and Stroke Control for a Double Acting Stirling Engine," both filed by David M. Berchowitz concurrently herewith, the disclosures of which are incorporated by reference herein.

The conventional mechanisms for converting between the reciprocating motion of a piston and rotating motion of a shaft developed for internal combustion engines are used primarily because of their reliability. However, there are some disadvantages connected with their use which are inherent in their design. They are heavy and bulky and require a large volume crankcase. Moreover, they exert substantial sideloads on the piston rod.

The power control techniques for Stirling engines that have been developed and adopted to date are usually effective but are often expensive, complicated, and unreliable, and sometimes introduce distinct torque jumps in operation rather than a smooth power transition. They present servicing problems which are well beyond the abilities of the average serviceman and also present manufacturing problems that would introduce severe quality control difficulties in any large scale manufacturing operation.

In order for the Stirling engine to be accepted by industry for wide scale production in applications requiring power modulation of a rotating output shaft, it will be necessary to improve the motion conversion device and provide a power control technique that is suitable for use in the real world.

SUMMARY OF THE INVENTION

Accordingly, it is an object of this invention to provide a conversion mechanism for converting between rotating and reciprocating motion. It is another object of this invention to provide a power control device for smoothly modulating the output power of the Stirling engine. Another object of the invention is to provide a mechanism for converting between rotating and reciprocating motion and which also can be used to control the output power of the Stirling engine. The device is light weight and small in volume, is easily manufactured by conventional fabrication techniques, is inexpensive, reliable, quiet, and efficient in operation and can be easily serviced by servicemen of average ability.

These and other objects of the invention are achieved in a motion conversion mechanism having a power lever pivotally mounted in the crankcase and having a cam follower bearing against a cam mounted on the output shaft. The piston rod bears against the power lever and the force of the piston rod on the cam follower rotates the cam and produces output power in the shaft. The position of the power lever can be moved transversely of the shaft to change the moment arm between the cam follower and the piston rod to change the torque on the shaft and also change the stroke of the piston. Increasing the moment arm reduces the torque and also reduces the piston stroke, both of which reduce engine power without significant loss in efficiency.

The lever arms can be mounted on opposite sides of the shaft for adjacent pistons in a Siemens type Stirling engine to provide an equal and opposite phase shift in adjacent pairs of pistons to provide a further mode of power modulation in this form of engine.

DESCRIPTION OF THE DRAWINGS

The invention and its many attendant objects and advantages will become better understood upon reading the following description of the preferred embodiment in conjunction with the following drawings, wherein.

DESCRIPTION OF THE PREFERRED EMBODIMENT

Figure 1:
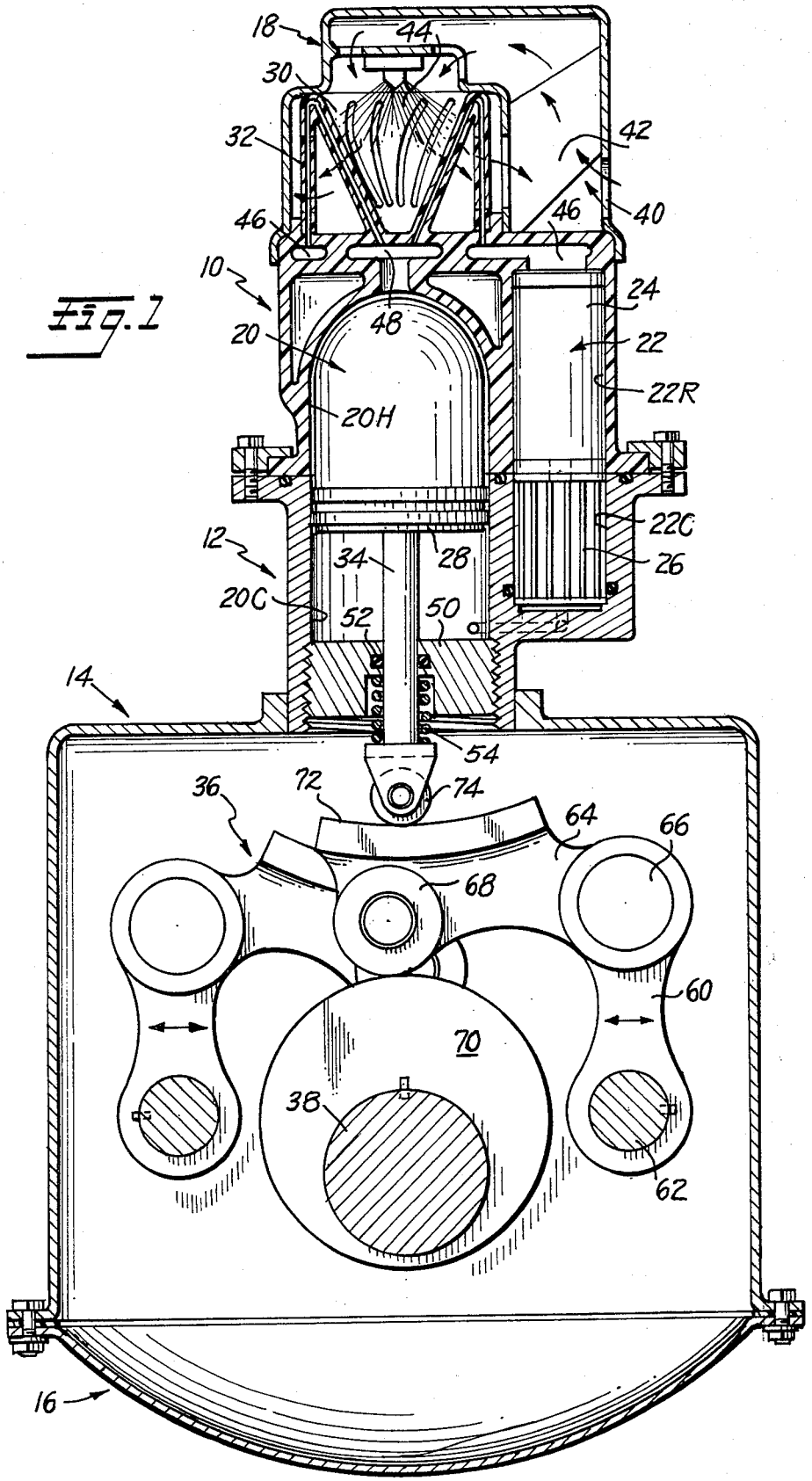
FIG. 1 is a schematic diagram of a Stirling engine employing a motion conversion and power control mechanism according to this invention.

Turning now to the drawings, wherein like reference characters designate identical or corresponding parts, and more particularly to FIG. 1 thereof, a double-acting Stirling engine is shown having a monolithic ceramic heater head 10 mounted on an engine block 12 which in turn is fastened to a crankcase 14, closed at its lower end by an oil pan 16. A combustor 18 is mounted on the top of the heater head 10 to burn fuel and convert its chemical energy to heat energy which is converted by the Stirling cycle into mechanical energy.

Figure 2:
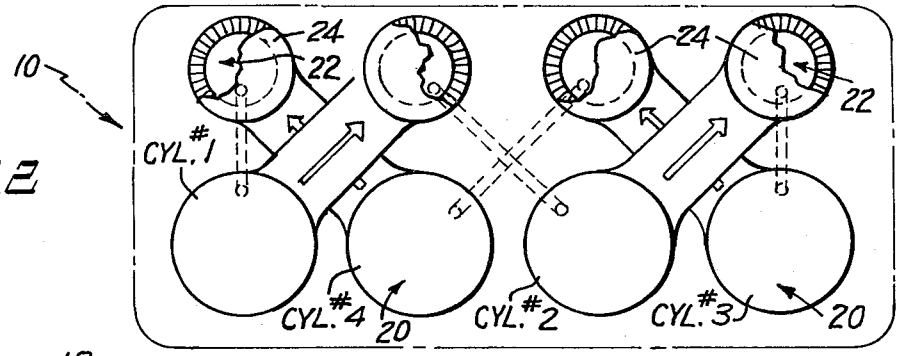
FIG. 2 is a schematic plan view of a double-acting in-line Stirling engine showing the interconnection between the cylinders and heat exchangers.
Figure 3:
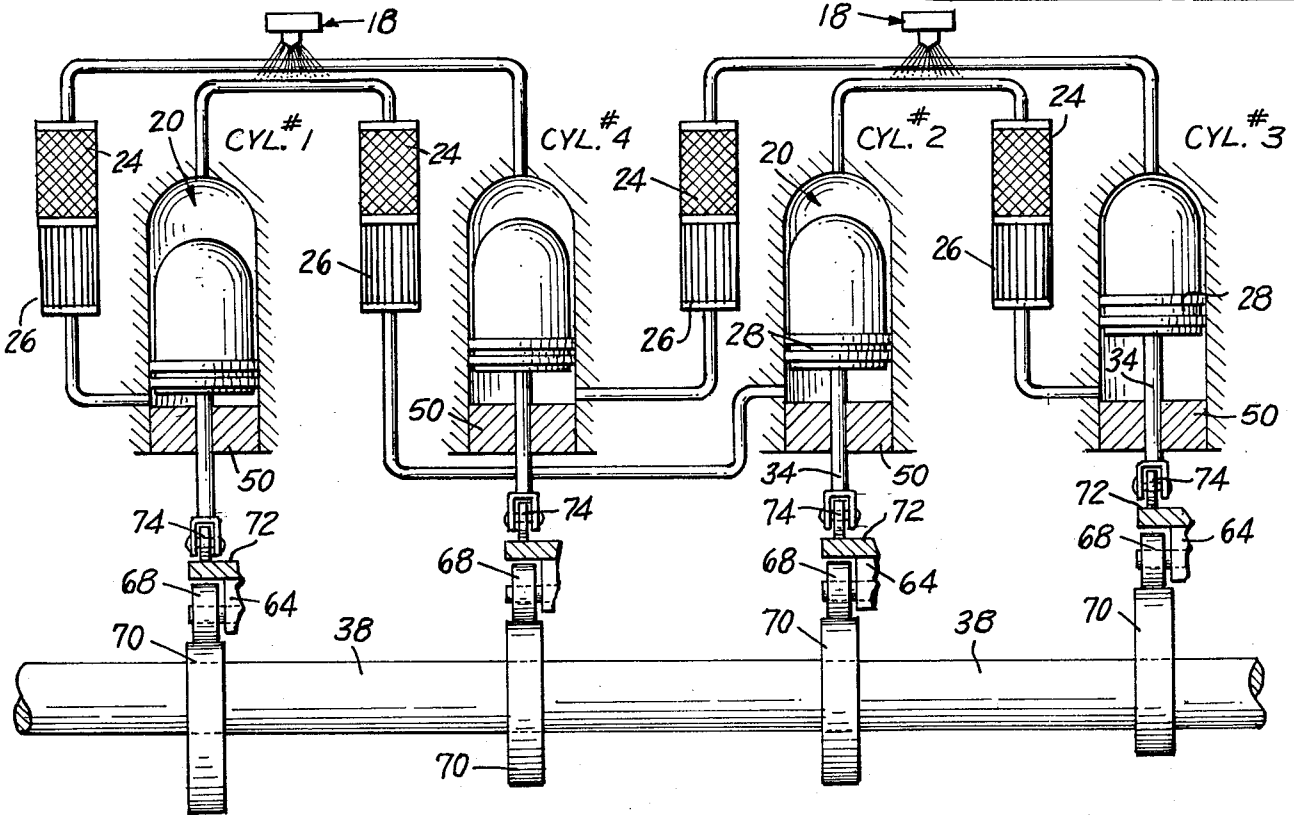
FIG. 3 is a schematic elevation of an in-line Siemens type Stirling engine employing the motion conversion and power control mechanism of this invention.

As shown in FIG. 2, the engine configuration is in the form of a straight line of four power cylinders 20 adjacent a row of four heat exchangers 22. The straight line configuration simplifies the packaging of the engine in a front wheel drive automobile, and the single drive shaft provides a lighter and less expensive arrangement with fewer bearings and power transfer gears. The absence of gears also reduces engine noise. The engine is a double-acting or Siemens type Stirling engine as shown in FIG. 3 wherein each of the four working spaces is comprised of an expansion space in one cylinder above a first piston, the space of the heater, regenerator and cooler, and the volume of the compression space in the cylinder below a second piston which normally leads the first piston by 90°. The pistons, numbered in their phase order, are arranged out-of-phase order with piston No. 4 between piston Nos. 1 and 2. This design permits a compact arrangement of the heat exchangers and the interconnecting ducts between the cylinders and the heat exchangers to minimize the engine dead space and to minimize the heat conduction losses from the engine hot side to the engine cold side. Moreover, it facilitates simple heater head construction which can be molded out of one or two monolithic blocks of ceramic material for strength, low cost, low heat conduction losses, ease of replacement in the event of breakage, and ease the fabrication of the engine assembly. The heater head material is silicon nitride or preferably alpha silicon carbide which is extremely tough and gas impervious over a wide range of temperature conditions and can be easily fabricated in a variety of complex shapes.

The heater is in the form of a heater body having a cone 30 and a skirt 32 depending from the top wide mouth of the cone 30. The cone and the skirt are grooved or scored with a pattern of volute channels running from the center or lower portion of the cone 30, up over the top in a volute pattern and then straight down the depending skirt portion 42. After the channels are formed in the heater body, a layer of covering material is applied on the surface of the heater body in which the channels are cut and fins or passages between the channels are formed in the heater body to increase the surface area and provide a gas flow passage for the combustion gases from the conical portion to the cylindrical portion of the heater body. The heater body is then heat treated to bond the covering of the channels and achieve the desired physical properties of the material. This final heat treating process can be accomplished at the same time the heater body is attached to the heater head in a position to be described below.

The heater head 10 is formed with two rows of four cylinders each as shown in FIG. 2. One row of cylinders 20H contains the pistons and the other row of cylinders 22R contains the regenerator 24.

The outline of the engine operation will be described first and then the structural details of the engine will be explained and their functional relationship to the engine operation will be clear. The engine is a double-acting Stirling engine wherein the pistons 28 function both as displacers and pistons. That is, they displace working gas through the heat exchangers to generate a pressure wave in the working space, and they move under the influence of the pressure wave to produce kinetic energy of the piston rod 34 which is converted by a motion conversion mechanism 36 to rotating output power of a shaft 38 journaled for rotation in the crankcase 14. Air for combustion in the combustor 18 is taken into the combustor through an air intake 40 and passes through a preheater 42 where it is raised to high temperature by the heat in the exhaust gas which passes countercurrent through the preheater. The hot combustion air then is mixed with fuel and burned in a flame 44 directed into the cone of the heater 30. The combustion gases pass through the slots in the heater cone and the heater skirt 32 and then pass out through the preheater 42 whereby they raise the temperature of the incoming combustion air.

The heater skirt 32 is connected to the top of the heater head at an outside annular manifold 46 which communicates with the regenerator cylinder 22R and the heater cone 30 is connected to an inside manifold 48 which communicates with the expansion space of the cylinder 20H. When the piston moves downwardly, the working gas is transferred through the cooler 26, and the regenerator 24 where it is heated by the heat deposited by the gas on its previous pass through the regenerator. The gas then flows into the manifold 46 and through the heater 30 where it is further heated and expands by way of the manifold 48 into the expansion space of the cylinder 20H against the piston 28, producing useful work. On the up stroke of the piston 28, the working gas is expelled by the piston 28 into the manifold 48, through the heater 30, into the regenerator 28 by way of the manifold 46. In the regenerator 28, the hot working gas deposits its heat into the regenerator matrix which heat is available to reheat the working gas on its return trip back into the expansion space in the next cycle.

The engine block or water jacket 12 has formed therein a set of cylinders 20C and 22C aligned with the corresponding cylinders 20H and 22R in the heater head 10. The heat exchanger cylinder 22C in the water jacket contains the cooler 26 which cools the working gas in the Stirling cycle. The power cylinder 20C is closed at its lower end by a seal housing 50 which contains a piston rod seal shown schematically at 52. The seal housing 50 also contains a spring 54 biased between the seal housing 50 and the bottom end of the piston rod 34 to bias the piston rod downwardly against the motion conversion mechanism 36.

The motion conversion and power control mechanism 36 achieves its power control function by changing the dead (unswept) volume in the working space, changing the mean pressure of the working gas, changing the magnitude of the pressure wave in the working gas, changing the force transmitted from the piston rod to the shaft 38, and changing the phase angle between adjacent pistons. These control techniques are achieved by selective positioning of the power lever in the mechanism thereby eliminating the need for the complicated, expensive and unreliable system of sensors, valves, and plumbing in the conventional power control systems employed at the present.

The structure of the motion conversion and power control device will now be described. The device includes a cam 70 and a pair of levers 60 and 64 vertically aligned directly under each piston rod in the engine. One set of cam and levers for one piston rod will be described with the understanding that the structure is identical for each other set except where differences are set forth.

A control lever 60 is keyed to a control shaft 62 journaled for control rotational movement in the crankcase 14. A power lever 64 is pivotally mounted at a pivot 66 on the top end of the control lever 60 and extends transversely across the top of the power output shaft 38 to a cam follower 68 mounted on the inner end of the power lever 64 in engagement with an eccentric body such as a circular cam 70 which is keyed to the shaft 38 and rotates with it. The cam follower 68 is a roller mounted on the lever 64 by rolling element bearings for long life, low friction and high load capacity. The top surface of the power lever 64 has a hardened arcuate bearing surface 72 which engages a roller 74 mounted on the end of the piston rod 34.

In operation, the force exerted by the piston rod is transmitted through the roller 74 to the top surface 72 of the power lever 64 and through the cam follower 68 to cam 70. The force is exerted by the cam follower 68 perpendicular to the tangent of the cam at the point of contact which, at all positions other than top dead center and bottom dead center is offset from the axis of the shaft 38 and therefore produces a torque on the shaft 38. The magnitude of this torque varies with the crank angle of the cam 70, being zero at top and bottom dead center and maximum at about 90°. The advantage of a cam over a conventional crank mechanism is the flexibility in the cam shape. It can be machined in shapes other than circular to give a motion profile to the piston that is more suitable to the Stirling cycle if desired. For example, dwells and fast position changes and other nonsinusoidal-type movements can be employed with the use of a cam that are not possible with a conventional crank mechanism.

The power control of this mechanism can utilize both stroke and phase control. The stroke control is achieved by control movement of the control lever 60. Movement of the control lever 60 changes the effective moment arm between the piston rod 34 and the contact point of the cam follower 68 on cam 70 so that the stroke and the force exerted by the cam follower are both changed. The range of motion of the cam follower 68 will always remain constant because it follows the cam and therefore its stroke will always be the difference between the high and low cam radii. However, the point of contact between the piston rod roller 74 and the bearing surface 72 of the power lever 64 will change depending on the position of the control lever 60. Increasing the moment arm between the cam follower and the piston rod roller 74 decreases both the force transmitted from the piston rod to the cam 70 and the stroke of the piston rod. The arcuate shape of the bearing surface 72 insures that the top dead center position of the piston will always be near the top of the cylinder 20 so that, at short stroke positions of the power lever, the majority of the working gas will be in the cooled or compression space below the piston which effectively reduces the mean pressure of the gas in the working space and thereby reduces the pressure forces acting on the power train and reduces output power, and it also reduces the windage and heat conduction losses through the system. The short stroke position also reduces engine idle speed which further contributes to fuel economy at low power levels. In addition, the stroke reduction increases the effective dead volume which also decreases the power of the engine. The shorter stroke of the piston in this embodiment reduces the magnitude of the pressure wave because a smaller amount of gas is passed through the heat exchangers and therefore the force exerted by the piston through the piston rod on the motion conversion mechanism is smaller than it is at full stroke. The smaller force exerted on a longer moment arm produces a smaller torque on the shaft 38 than occurs at higher stroke positions of the power lever 64. The stroke control can also be used to reduce or eliminate after-run by moving to low or zero stroke to stop the engine.

The phase control which this invention provides enables the power in a Siemens-type Stirling engine to be controlled by the relative phase position of the pistons in the engine. This is achieved by moving the control levers 60 of the mechanisms for the different pistons differentially so that in this way, the phase angle between adjacent pistons, which is normally 90° in a four cylinder Rinia engine, will be changed to $90°+\alpha$ between two pairs of pistons and $90°-\alpha$ between the other two pairs of pistons. In this way, the power developed in each of the cylinders is nearly equal so that strong torque vibrations are not set up in the power output shaft 38.

The control movement of the power lever 64 can be done by means other than the control lever 60 on the control rod 62. The position of the power lever 64 can be controlled by hydraulic actuators either simultaneously and equally in which case phase control would not be used, or they could be controlled from opposite sides of the power shaft 38 simultaneously and equally in opposite directions in which case phase control would be used. The control lever could also be controlled from a single side of the power output shaft 38 moved in opposite directions in pairs or individually to achieve phase control, or they could be moved in the same direction equally on a single actuator from the same side of the power output shaft, in which case phase control would not be used.

The motion conversion device and power control disclosed herein is a simple and inexpensive mechanism that is easily manufactured by conventional manufacturing techniques and can be fabricated and assembled by production line workers of average ability. It would be easily serviced by servicemen of average ability without extensive training necessary. It is ideally suited to the Stirling cycle machine because of the absence of high pressure peaks which occur in the internal combustion engine so that the stress in the cams and cam followers does not exceed allowable limits. Moreover, the phase control and stroke control potential of the mechanism makes it ideally suited for the Stirling cycle because of the high efficiencies that can be achieved at low and intermediate power levels. The phase and stroke control can be achieved independently using hydraulic actuators on the power lever by operating in-phase with stroke control or out-of-phase with stroke control. The parameters of control, namely, phase control, stroke control and various combinations of the two can be programmed for different driving conditions in a microcomputer and the control can be achieved automatically under the influence of a single control movement by the driver such as an accelerator pedal.

Obviously, numerous modifications and variations of the disclosed preferred embodiment are possible and will occur to those skilled in the art in light of this disclosure. For example, the invention is not limited to use in the particular form of Stirling engine shown and is not limited to use in a Stirling engine with a ceramic heater head. Accordingly, it is expressly to be understood that these modifications and variations, and equivalents thereof, may be practiced while remaining in the spirit and scope of the invention.

What is claimed is:

1. A power control/motion conversion device for a Stirling engine having a plurality of pistons for moving a working gas cyclically through a closed working space containing a heater, regenerator and cooler which creates a pressure wave in the gas in the working space, and for moving under the influence of the pressure wave to produce reciprocating output power, the reciprocating output power being converted hereby to rotary output power of a shaft mounted in the engine crankcase on an axis lying perpendicular to the axes of the pistons, said power control comprising a plurality of control mechanisms, each including:

a power lever having a cam follower on one end and a bearing surface against which the piston operatively bears;

a cam mounted on said shaft in contact with said cam follower;

a pivot at the other end of said power lever for pivotally mounting said lever in said crankcase to swing in a plane perpendicular to said shaft and containing said piston axis; and means for moving said pivot in said plane laterally with respect to said shaft to change the lever arm between said can follower and the point at which said piston operatively bears on said lever bearing surface, and thereby change the stroke of said piston and the force of said cam follower on said cam.

2. The power control defined in claim 1, wherein said bearing surface is concave so that the axial position of the piston will remain constant with respect to the relative angular position of said cam and cam follower.

3. The power control defined in claim 1, said pivot moving means further comprising a control lever at said pivot, and mounted at the other end to a control shaft, said control shaft being mounted for rotation about its axis to swing said control lever through a sector and move said pivot through an arc in said plane.

4. The power control defined in claim 1, further comprising biasing means for maintaining operative serial contact between said piston, said bearing surface, said cam follower, and said cam.

5. The power control defined in claim 1, wherein said Stirling engine is a double-acting type, and wherein said power levers for adjacent pistons are on opposite sides of said power output shaft whereby equal and simultaneous movement of all power levers produces an equal and opposite phase shift between adjacent pair of pistons, thereby changing the output power of said engine.

6. A phase and stroke control device for changing the piston stroke and the phase angle between pistons of a double acting Stirling engine having a plurality of pistons, comprising:

an output shaft;

a plurality of bodies eccentrically mounted on said shaft, one for each piston;

a plurality of followers, one each engaging one of said bodies at a variable angular position;

a plurality of power levers, each having one of said followers mounted at a first end;

a plurality of pivot points, one each pivotally associated with a second end of each of said power levers;

a plurality of piston rods, each operatively engaging one of said power levers at a variable position intermediate said ends of said levers such that each piston is operatively associated with one of said followers; and means for moving each of said pivot points so as to change said position of engagement of said piston rod on said power lever and change said angular position of engagement of said followers on said body.

7. The phase and stroke control device defined in claim 6, wherein changing the position of engagement of said piston rod on said power lever changes the length of the piston stroke.

8. The phase and stroke control device defined in claim 6, wherein said means for moving each of said pivot points further comprises means for moving each of said power levers laterally with respect to said output shaft so as to move said follower angularly around said bodies.

9. The phase and stroke control device defined in claim 8, wherein said means for moving each of said power levers for adjacent pistons further comprises control levers on opposite sides of said output shaft such that equal and simultaneous movement of all power levers produces an equal and opposite shift between adjacent pairs of pistons, thereby changing the output power of said engine.

* * * * *